US006529172B2

(12) United States Patent
Zimmerman

(10) Patent No.: US 6,529,172 B2
(45) Date of Patent: Mar. 4, 2003

(54) DUAL-POLARIZED RADIATING ELEMENT WITH HIGH ISOLATION BETWEEN POLARIZATION CHANNELS

(75) Inventor: Martin L. Zimmerman, Chicago, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/906,333

(22) Filed: Jul. 16, 2001

(65) Prior Publication Data

US 2002/0021257 A1 Feb. 21, 2002

Related U.S. Application Data

(60) Provisional application No. 60/227,811, filed on Aug. 25, 2000, and provisional application No. 60/224,708, filed on Aug. 11, 2000.

(51) Int. Cl.[7] ..... H01Q 21/26; H01Q 9/28

(52) U.S. Cl. ..... 343/797; 343/795; 343/810

(58) Field of Search ..... 343/793, 795, 343/797, 798, 810, 815, 818

(56) References Cited

U.S. PATENT DOCUMENTS

| | | | | | |
|---|---|---|---|---|---|
| 4,446,465 | A | | 5/1984 | Donovan | 343/797 |
| 4,686,536 | A | * | 8/1987 | Allcock | 343/700 MS |
| 5,629,713 | A | | 5/1997 | Mailandt et al. | 343/808 |
| 5,952,983 | A | | 9/1999 | Dearnley et al. | 343/817 |
| 6,069,590 | A | * | 5/2000 | Thompson, Jr. et al. | 343/795 |
| 6,072,439 | A | | 6/2000 | Ippolito et al. | 343/797 |
| 6,310,584 | B1 | * | 10/2001 | Reece et al. | 343/816 |
| 6,342,867 | B1 | * | 1/2002 | Bell | 343/795 |

* cited by examiner

*Primary Examiner*—Tan Ho
(74) *Attorney, Agent, or Firm*—Jenkens & Gilchrist

(57) ABSTRACT

A radiating element for use in a dual-polarized radiating apparatus with isolation between polarization channels has a dielectric body having one or more conductive radiators thereon. The dielectric body has oppositely outwardly extending lateral edge portions which extend beyond lateral outer edges of the conductive radiators. Cooperating joining structure interengages an edge of each dielectric body with an adjacent edge of an adjacent dielectric body to form at least a portion of the dual polarized radiating apparatus.

35 Claims, 5 Drawing Sheets

DUAL-POLARIZED RADIATING ELEMENT WITH HIGH ISOLATION BETWEEN POLARIZATION CHANNELS

CROSS-REFERENCE TO RELATED APPLICATION

This provisional application claims the benefit of the prior U.S. provisional patent application Serial No. 60/227,811, filed Aug. 25, 2000 which claimed the benefit of prior U.S. provisional patent application Serial No. 60/224,708, filed Aug. 11, 2000 both entitled "Dual-Polarized Radiating Element With High Isolation Between Polarization Channels."

FIELD OF THE INVENTION

This invention is directed generally to the antenna cuts, and more particularly radiating elements for antennas.

BACKGROUND OF THE INVENTION

Many wireless and broadcast applications require transmission and/or reception on orthogonal linear polarizations. This may be done for a variety of reasons. In some applications, transmission is done with one polarization and reception is done with the orthogonal polarization in order to provide isolation between the transmitted and received signals. In other cases energy is received on both polarizations and the signals are combined by a method that increases the signal/noise ratio, providing polarization diversity gain. In order to implement these schemes effectively, it is necessary that a relatively high level of isolation exist between the two polarizations. For array antenna applications, aesthetic and environmental requirements make it desirable for the two polarizations to be emitted from a single multi-component radiating structure.

There are several types of radiating structures that provide for highly-isolated orthogonal radiation within a compact structure. One is a square patch, which can be made to radiate from orthogonal edges. Another is a pair of dipoles, arranged orthogonally and crossing at their midpoints. A third method involves arranging four dipoles so that each dipole defines one side of a square which has a side length larger than the length of the dipoles so that the edges or tips of the dipoles do not touch at the corners of the square. Each polarization is emitted by one of the two pairs of parallel dipoles thus defined, which are fed so as to radiate with equal amplitude and phase.

A given dipole couples strongly, typically at levels of −9 to −12 dB, with the neighboring orthogonal dipoles. However, if the two parallel neighboring dipoles are fed with equal phase and amplitude and are arranged symmetrically with respect to the orthogonal dipole(s), then the coupled energy from one neighboring dipole will be of equal magnitude and opposite phase as energy from the other neighboring dipole. The two coupled fields therefore cancel out. In practice, coupling levels of less than −30 dB may be achieved.

OBJECTS OF THE INVENTION

Accordingly, it is a general object of the invention to provide a dual-polarized radiating element with high isolation between polarization channels and a method of wireless communications utilizing such a radiation element.

SUMMARY OF THE INVENTION

Briefly, in accordance with the foregoing, a radiating element for use in a dual-polarized radiating apparatus with isolation between polarization channels comprises a dielectric body having one or more conductive radiators thereon, said dielectric body having oppositely outwardly extending lateral side portions which extend beyond lateral outer edges of said conductive radiators, and cooperating joining structure for interengaging an edge of said dielectric body with an adjacent edge of a similar dielectric body to form at least a portion of said dual polarized radiating apparatus.

DETAILED DESCRIPTION OF THE ILLUSTRATED EMBODIMENT

In a dual-polarized, four dipole antenna of the type described above, there are two primary effects that can increase the coupling and therefore decrease the isolation between the two polarization channels. One is spacing and orientation of the dipoles relative to one another. This is significant, since a difference in distance or orientation leads to coupled fields that do not cancel out as completely. A second effect is scattering from features of the antenna structure, such as the edges of a ground plane or reflector. The present invention allows these errors to be substantially eliminated or corrected.

Figure 2:
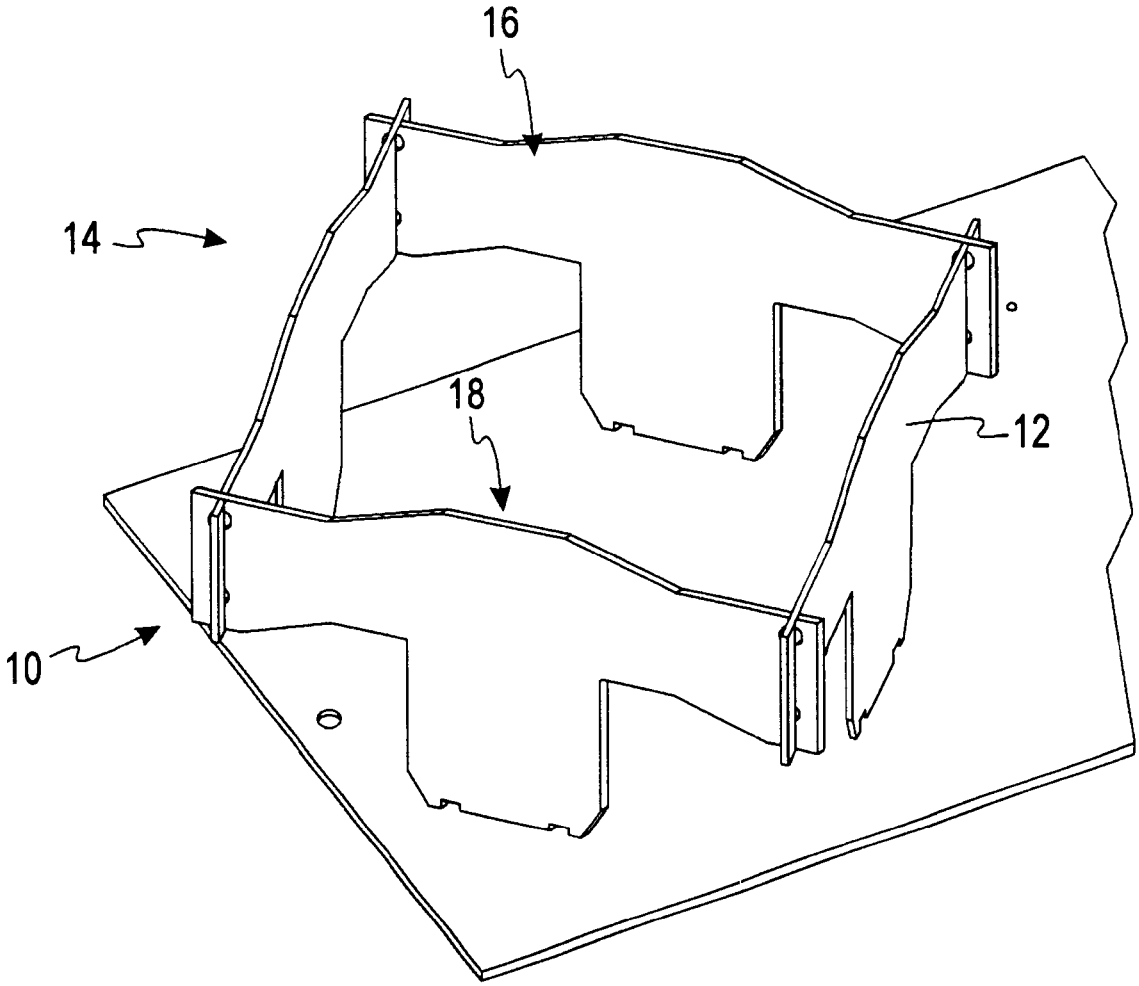
FIG. 2 is an isometric view of an assembled four-radiating element radiator assembly on a PC board which contains a feed network.
Figure 3:
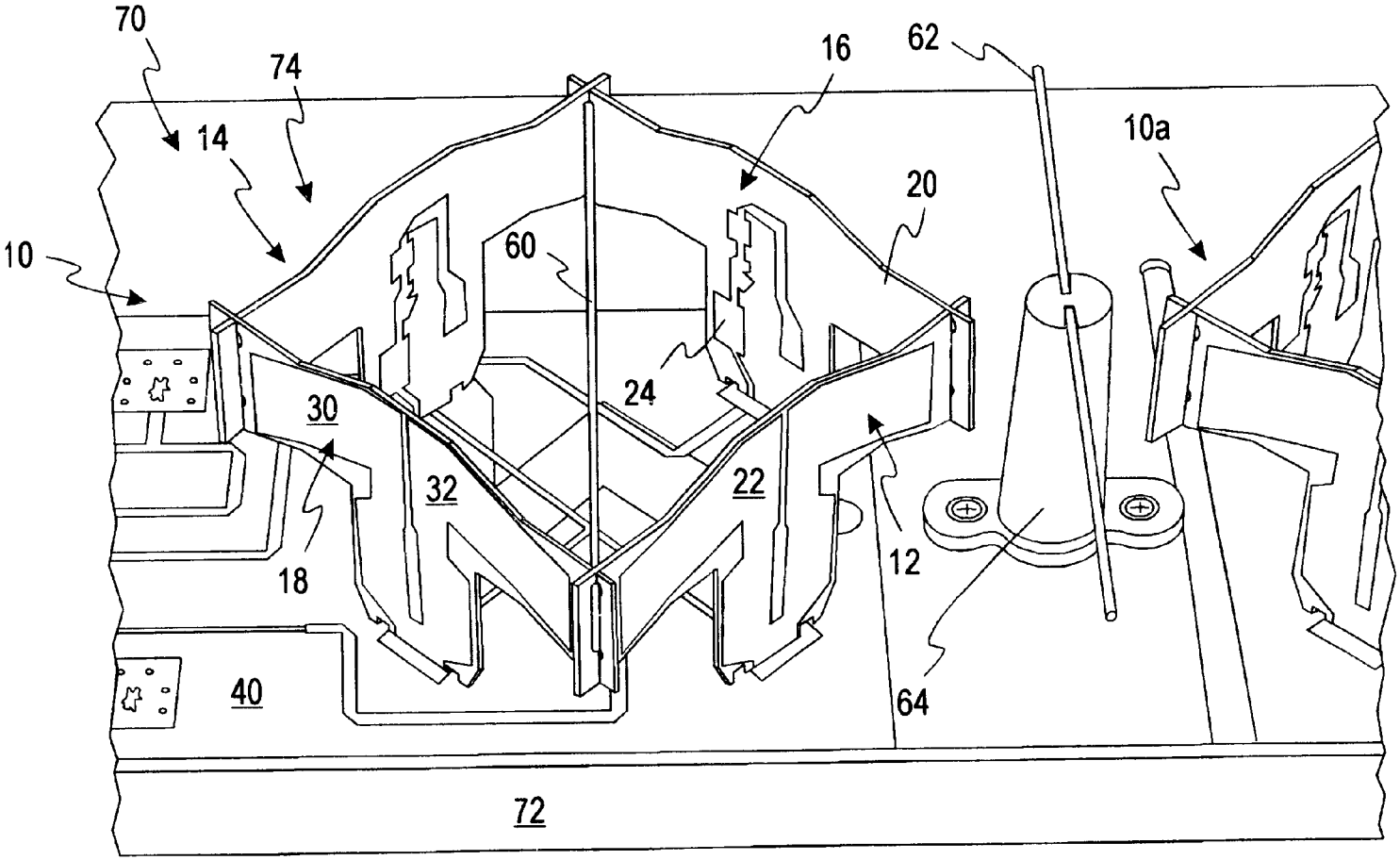
FIG. 3 is an isometric view showing further details of a radiating structure assembled in an antenna structure with a parasitic wire at an intersecting line of the radiator.

Referring now to the drawings, the radiator 10 of the invention utilizes four radiating elements 12, 14, 16 and 18 arranged in a generally square or box-like configuration, as best viewed in FIGS. 2 and 3. The four radiating elements are substantially identical, whereby only one need be described in detail. Each radiator (see FIGS. 4 and 5) is formed from a non-conductive sheet material with a thin layer of metal or other conductive material on one or both sides. The conductive material may be applied or attached by various known methods. In the illustrated embodiment, the non-conductive sheet 20 is a thin, low-loss dielectric substrate, such as a printed circuit board (PCB). In the illustrated embodiment, a 0.03 inch thick sheet is used, however, other thicknesses may be utilized without departing from the invention. Moreover, the dimensions may be scaled in accordance with the frequency to be transmitted and/or received by a particular radiator.

On either side of the non-conductive sheet 20 is a metal layer 22, 24, which in the illustrated embodiment is approximately 0.0014 inches thick electro deposited copper. These layers 22 and 24 are shaped to form a radiating dipole arrangement 22 on one side and a microstrip feedline 24 for the dipole 22 on the other side of the sheet 20. In this regard, it will be seen that each of the radiating elements 12, 14, 16, 18 comprises a generally T-shaped member, such that the metal layers 22 forming the radiating dipole portion project from a base portion of the T upward and outward to the legs of the T, with a space therebetween. The two dipoles 30, 32 thus formed join at a base portion 34 of the T-shaped element which in turn forms a tab or projection which may either fit with a complimentary slot (not shown) in a feedboard or PC board 40 which contains a feed network or structure for the radiator 10. Specifically, the conductive material at the tab 34 which forms an end portion of the two dipole elements 30 and 32 couples with a ground plane of the feedboard 40.

On the other side of the dielectric substrate 20 is located a microstrip feedline 24 which also couples at the tab 34 to a corresponding portion of the feed network formed on the feedboard 40. This microstrip feedline 24 effectively crosses the gap between the two radiating arms of the dipole 22 to provide a feed structure for the dipole.

The radiating elements 30, 32 of the dipole 22 and the microstrip feedline 24 may have other specific designs or configurations, or utilize other alternative structural arrangements without departing from the invention. However, the invention contemplates a dielectric substrate 20 on which the radiating elements and feed structure are carried. For example, in the illustrated embodiment, the radiator consists of two dipole arms on the same side of the dielectric substrate separated by a gap and the dipole is fed by a microstrip line on the other side of the substrate which runs across the gap. In another embodiment, the first side could contain two sections of metal separated by a tapered slot which runs from the top edge of the radiator down towards the bottom edge with the slot width increasing as the top edge is approached. In another embodiment, the radiator can be a folded dipole located entirely on one side of the substrate, with the transmission line formed by two edge-coupled sections of metal on the same side of the substrate. There are many other PC board based radiators that will work that are familiar to antenna engineers skilled in the art.

In accordance with the invention, the radiating elements 30 and 32 of each dipole extend oppositely outwardly a distance less than the width of the substrate 20 from side-to-side. That is, the extent of the substrate 20 from side-to-side is greater than the extent of the metalization forming the radiating elements 30, 32. This dimension is also selected to be greater than the distance separating the parallel radiators in the assembled radiator structure shown in FIGS. 2 and 3, whereas the extent of the metalization of the elements 30 and 32 is somewhat less in width than this distance between parallel radiators.

Figure 1:
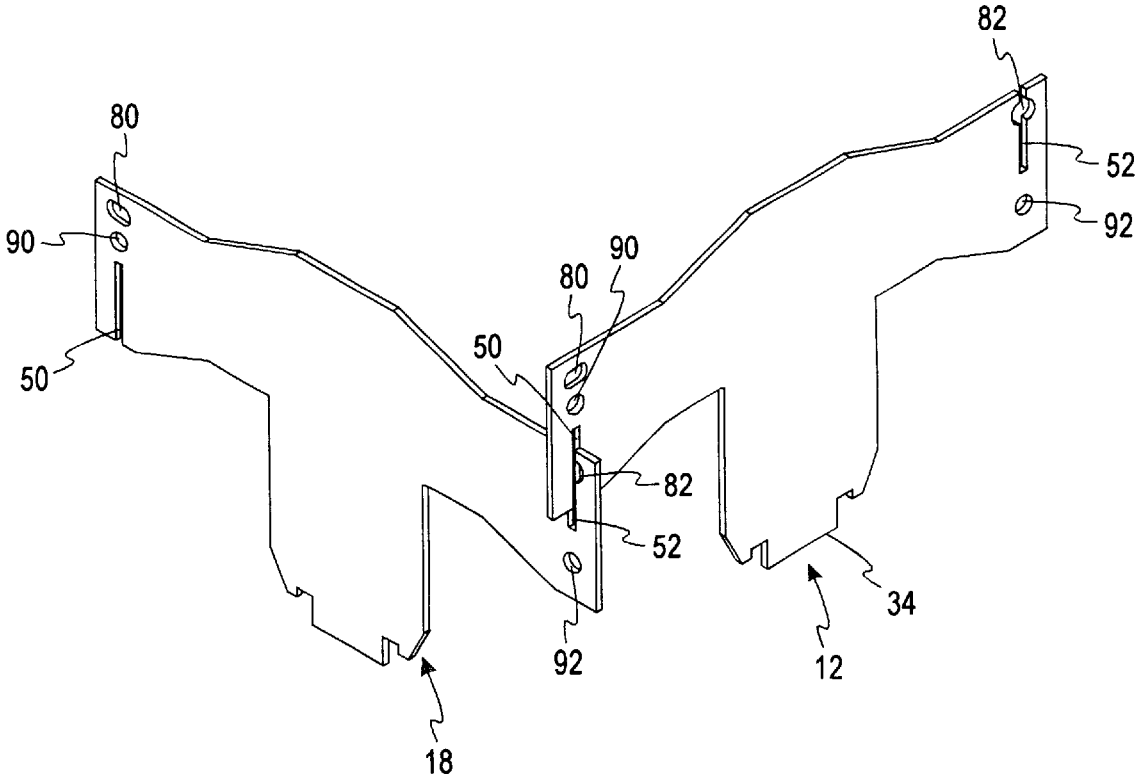
FIG. 1 is an isometric view of two radiating elements being assembled in a boxlike configuration.

End portions of the substrate 20, located laterally outwardly of the metalized portions 30 and 32 are formed with complementary slots 50, 52 which slidably interfit as shown in FIG. 1, in order to assemble the four radiators 12, 14, 16, 18 into the square or box-like configuration shown in FIGS. 2 and 3. This structure advantageously permits the tips of the radiating elements 30, 32 of each dipole to be held in a precise location relative to each other dipole while preventing the conductive edges of adjacent dipoles from touching. This also lends some rigidity and structural integrity to the completed structure as shown in FIGS. 2 and 3. As noted above, a significant problem in arranging four dipoles in a square configuration in the prior art was that of maintaining the opposite pairs of dipoles in proper configuration, and particularly the proper alignment of the outer edges or tips of the radiating elements of the dipoles relative to each other. The present invention solves these problems. Since the radiating elements configured and assembled in accordance with the invention reliably maintain the geometry of the square radiator structure, the coupled energy from each pair of radiators to the other pair will be equal in magnitude and opposite in phase thereby cancelling.

In the illustrated embodiment, a long thin conductor such as a strip, rod, or wire 60 is run between opposing comers of the square or box-like radiator. More specifically, the orientation of the square radiator and of the strip or wire 60 is such that the wire 60 runs across the shorter dimension of a reflector 70 on which the radiator structure 10 and feedboard 40 are mounted. This reflector 70 has opposite upstanding sides 72, 74, such that the wire 60 runs orthogonally to and between these two sides, while the four sides of the radiator 10 are rotated at substantially 45° to the two sides 72 and 74 of the reflector 70. In the embodiment illustrated in FIG. 3, more than one radiator structure is utilized in the antenna mounted within the reflector 70, with a portion of a second such structure being indicated by reference numeral 10*a*.

Thus, the illustrated reflector has a long dimension along which the radiator structures 10, 10*a* are placed and a shorter dimension, namely between the upstanding walls 72 and 74. Other specific arrangements of radiators and reflectors and orientations of the parasitic strip or wire 60 may be utilized without departing from the invention. A similar element 62 may be used in addition to (or instead of) the element 60. The element 62 is an elongate conductor such as a wire, rod or metal strip and runs perpendicular to the sides 72, 74 (i.e., across the narrow dimension) of the reflector 70. A nonconductive standoff or post 64 mounts the parasitic element 62 in FIG. 3. However, other mounting arrangements may be used without departing from the invention (e.g., to a radome, not shown, which overlies the reflector 70 and the radiators 10*a*, 10*b*, etc.

It has been empirically determined that the presence of the conductor(s) 60 (and/or 62) can offset isolation degradation that may result from the presence of reflector edges (e.g., 72, 74) in the antenna.

In order to accommodate the wire or other conductor 60, each of the reflector panels or elements 12, 14, 16 and 18 has through openings or holes formed 80, 82 in outer edges of its dielectric substrate 20 which are substantially centered on the respective slots 50 and 52 thereof. These holes need to be somewhat elongated in order to accommodate the wire when the respective panels are slidably assembled in FIG. 1, thus the holes 80 and 82 are either oval or elliptical in shape, although alternatively they may be formed, as illustrated, by two circular holes with offset centers.

Additional holes 90 and 92 shown in FIG. 1 are utilized for alignment and positioning purposes during manufacture of the respective elements and have no function in the operation of the radiating structure. The respective conductive portions of the dipole 22 and the microstrip 24 which are formed at the base 34 of the T-shaped structure may be coupled to their corresponding ground plane and feed conductors of the feedboard by suitable means as by soldering.

Figure 5:
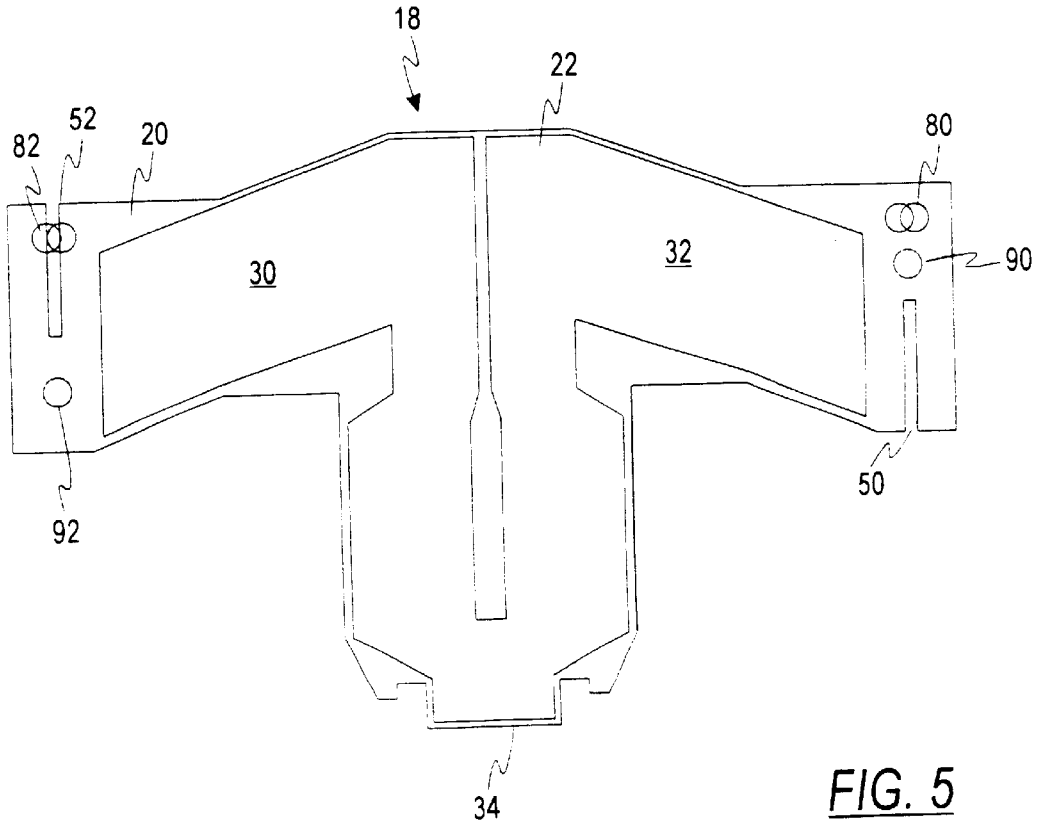
Figure 6:
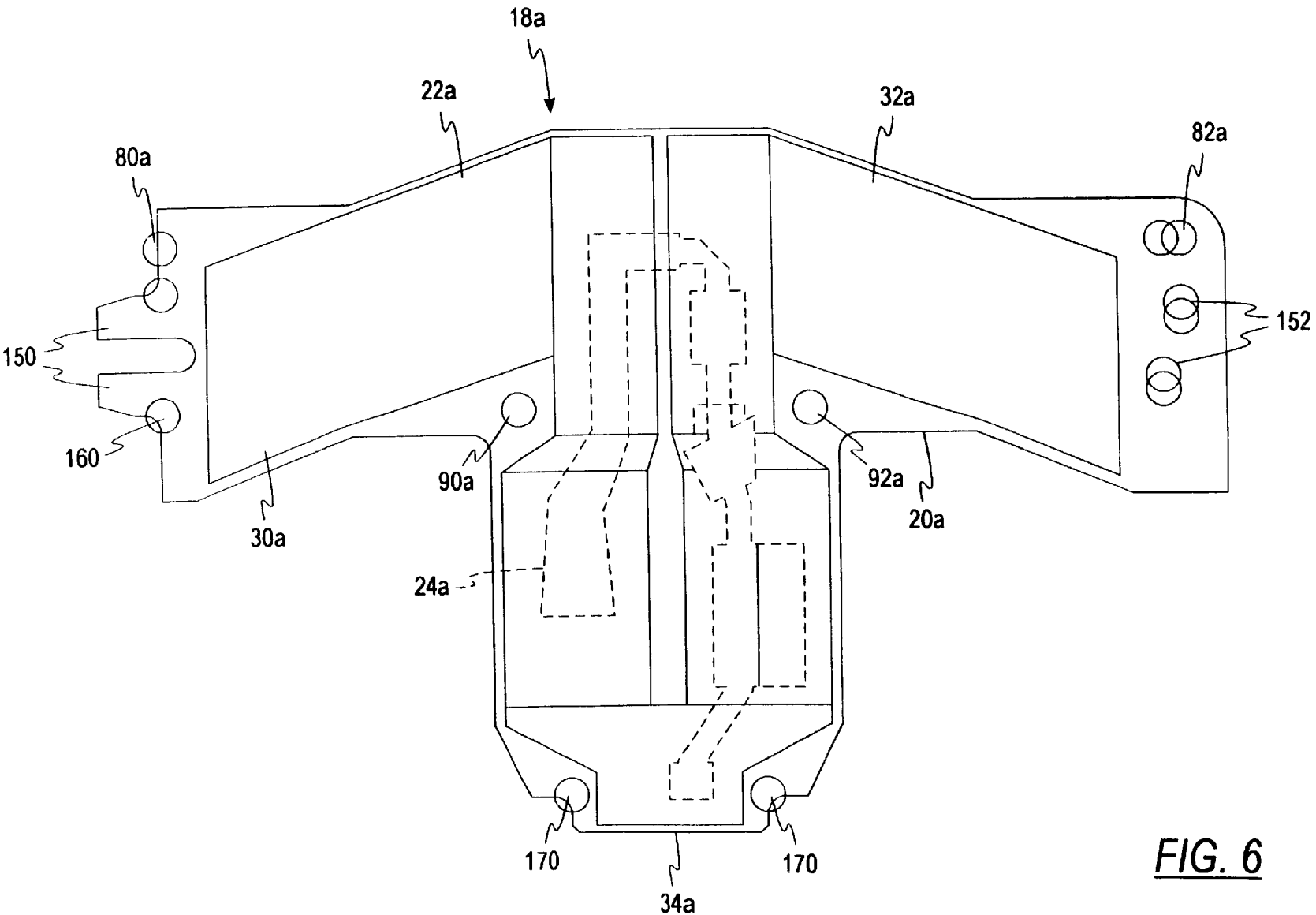
FIG. 6 is a front plan view of a second embodiment of a radiator.

Referring briefly to FIG. 6, a second embodiment of a radiating element is designated generally by the reference numeral 18*a*. The like elements and components of the radiating element 18*a* are designated by like reference numerals to those used in FIGS. 4 and 5, with the suffix a. Departing from the embodiment of FIGS. 4 and 5, end portions of the substrate 20*a* are formed at one edge with a pair of locking tabs 150 and at the opposite edge with a pair of locking slots or through openings 152. These tabs and slots 150 and 152 interlock to join four radiation elements generally in the configuration shown in FIGS. 2 and 3. In all other respects, the radiating element 18*a* is substantially identical to the radiating element 18. For ease of illustration, the radiating element 18*a* has been shown from one side, with the microstrip feedline 24*a* being shown in broken outline, indicating it is located on the side opposite that viewed in FIG. 6. That is, the metallization forming the dipole elements 30*a* and 32*a* is on one side of the panel 20*a* and the feedline 24*a* is on the opposite side. In the embodiment of FIG. 6, similar openings or slots 80*a* and 82*a* are provided for receiving a parasitic rod diagonally across the completed structure, shown for example, in FIG. 2 and FIG. 3. In this regard, two drilled holes 82*a* and a single drilled hole 80*a* are utilized. Because the T-shaped board 20*a* is not symmetrical, the opening or slot 80*a* appears as a notch or approximately one half of a circular cutout. When the four such elements 18*a* are assembled as shown in FIGS. 2 and 3, this opening 80*a* will form a suitable opening for receiving a parasitic element, as will the "double" hole 82*a* on the T-shaped board 20*a*.

Additional circular openings or cutouts 160 are provided at base portions of the tabs at 150 to create a barbed profile for interlocking with the holes or slots 152. In this regard, the slots 152 are offset somewhat so as to interfit snugly with the respective upper and lower tabs or barbs 150 upon assembly. That is, one of the openings 152 is offset to the right somewhat and the other to the left somewhat to create a secure fit with the tabs 150 which it will be remembered are relatively thin, for example, on the order of 0.030 inches, the thickness of the circuit board material 20*a* in the example given above. Similar cutouts 170 provided on the bottom tab 34*a* provide a snaplike lock or fit of this tab with a corresponding slot in the board or surface 40 (see FIG. 3). That is, the cutouts 170 give a barbed profile to the tab 34*a*. Openings 90*a* and 92*a* are used during the formation process.

Figure 4:
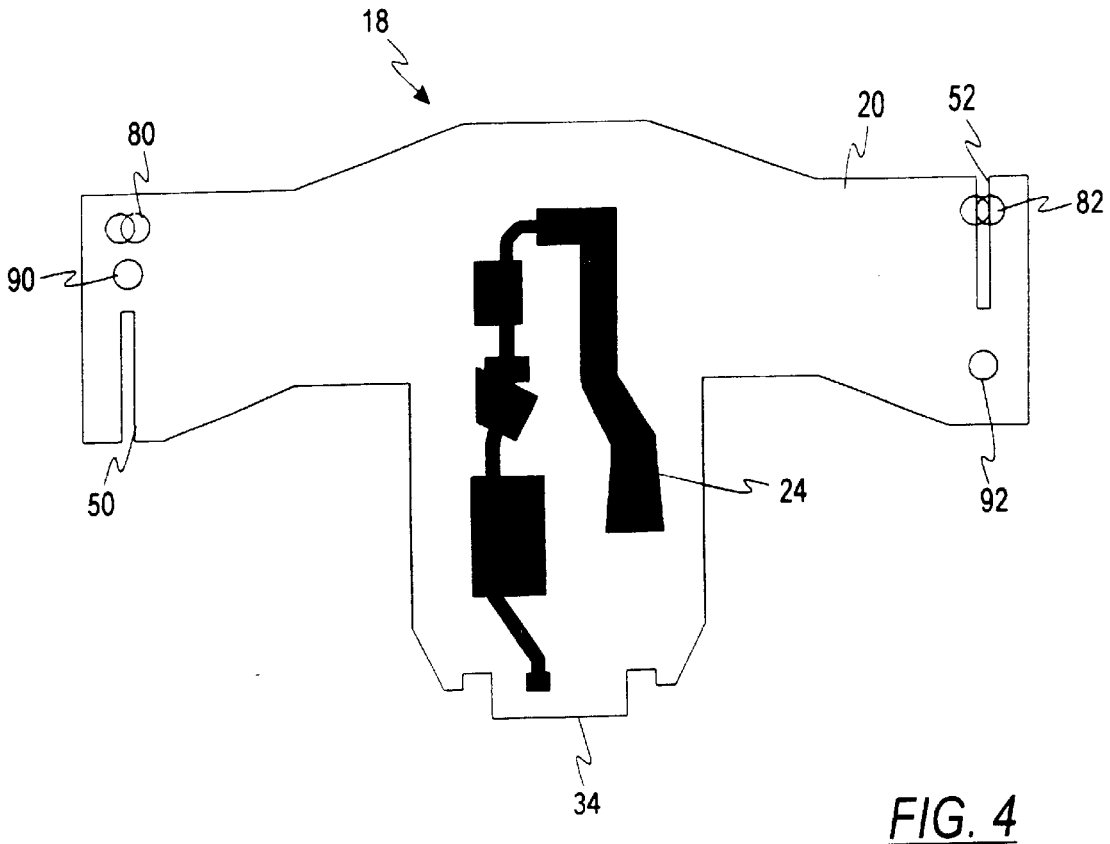
FIGS. 4 and 5 are front and rear plan views of one of the radiators of FIGS. 1 and 2.

In order to provide symmetry in the assembled structure as shown in FIG. 3, the T-shaped elements as shown in FIGS. 4, 5 and 6 are provided in two different forms, one being called "regular" and one being referred to as a "mirror image." This refers to the orientation of the feed pattern 24, 24*a* which is provided either in the orientation shown in FIG. 4 or in the orientation shown in FIG. 6. When the structure is assembled as shown in FIG. 3, the T-shaped dipole elements facing across from each other are selected with respective of regular and mirror image feeds such that the feeds are facing inwardly and have the same orientation, that is the one feed "overlies" the other feed substantially exactly.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A radiating element for use in a dual-polarized radiating apparatus with isolation between polarization channels, said radiating element comprising: a dielectric body having one or more conductive radiators thereon, said dielectric body having oppositely outwardly extending lateral edge portions which extend beyond lateral outer edges of said conductive radiators, and cooperating joining structure for interengaging one of said lateral edge portions of said dielectric body with an adjacent lateral edge portion of a similar dielectric body to form at least a portion of said dual polarized radiating apparatus.

2. The radiating element of claim 1 wherein the said joining structure is formed integrally in said lateral outer edges of said dielectric body.

3. The radiating element of claim 2 wherein said joining structure comprises slots formed in said lateral outer edges of said dielectric body configured and positioned for slidably interengaging complementary slots in a second like dielectric body.

4. The radiating element of claim 3 and further including through apertures centered on each of said slots, said through apertures having a cross-sectional dimension greater than that of said slot.

5. The radiating element of claim 1 and further including a projecting tab a portion of said dielectric body configured for engaging a complementary slot of a feedboard.

6. The radiating element of claim 5 wherein said conductive radiator extends into said tab for electrically conductive contact with a ground plane of a feedboard.

7. The radiating element of claim 1 and further including a conductive microstrip feed also formed on said dielectric body.

8. The radiating element of claim 7 wherein said conductive microstrip feed is formed on a side of said dielectric body opposite said radiator.

9. The radiating element of claim 7 and further including a projecting tab portion of said dielectric body configured for engaging a complimentary slot of a feedboard.

10. The radiating element of claim 9 wherein said conductive radiators and said conductive microstrip extend to said tab portion.

11. The radiating element of claim 1 wherein the joining structure comprises one or more tabs projecting from one lateral edge of said dielectric body and complementary slots adjacent an opposite lateral edge of said dielectric body.

12. A dual-polarized radiating apparatus with isolation between polarization channels comprising four radiating elements arranged in a generally square configuration to define a square radiating structure having preselected dimensions, each of said radiating elements comprising a dielectric body having one or more conductive radiators thereon, said dielectric body having oppositely outwardly extending lateral edge portions which extend beyond lateral outer edges of said conductive radiators, and cooperating joining structure for interengaging an edge of one said dielectric body with an adjacent edge of another said dielectric body so as to hold said four radiating elements together in assembled condition and defining said square of preselected dimensions.

13. The apparatus of claim 12 and further including a parasitic conductor extending diagonally across said square radiating structure.

14. The apparatus of claim 12 wherein said joining structure comprises slots formed in said lateral outer edges of each said dielectric body configured and positioned for slidably interengaging complimentary slots in an adjacent dielectric body.

15. The apparatus of claim 14 and further including through apertures centered on each of said slots, said through apertures having a cross-sectional dimension greater than that of said slot, said holes being configured and positioned for mounting said diagonal conductor.

16. The apparatus of claim 12 and further including a projecting tab a portion of said dielectric body configured for engaging a complimentary slot of a feedboard.

17. The apparatus of claim 16 wherein said conductive radiator extends into said tab for electrically conductive contact with a ground plane of a feedboard.

18. The apparatus of claim 12 and further including a conductive microstrip feed also formed on said dielectric body.

19. The apparatus of claim 18 wherein said conductive microstrip feed is formed on a side of said dielectric body opposite said radiator.

20. The apparatus of claim 18 and further including a projecting tab a portion of said dielectric body configured for engaging a complimentary slot of a feedboard.

21. The apparatus of claim 20 wherein said conductive radiators and said conductive microstrip extend to said tab portion.

22. The apparatus of claim 12 wherein the joining structure comprises one or more tabs projecting from one lateral edge of said dielectric body and complementary slots adjacent an opposite lateral edge of said dielectric body.

23. A method of achieving isolation between polarization channels of a dual-polarized radiating apparatus comprising: arranging four radiating elements in a generally square configuration to define a square radiating structure having preselected dimensions, each of said radiating elements comprising a dielectric body having one or more conductive radiators thereon and said dielectric body having oppositely outwardly lateral edge portions which extend beyond lateral outer edges of said conductive radiators; and interengaging an edge of each said dielectric body with an adjacent edge of an adjacent dielectric body to form said dual polarized radiating apparatus and to hold said four radiating elements together in assembled condition defining said square of preselected dimensions.

24. The method of claim 23 and further including providing a parasitic element extending diagonally across said square for offsetting isolation degradation from the presence of reflector edges.

25. An antenna structure comprising:

a reflector;

a feedboard mounted to said reflector; and a radiating structure mounted to said feedboard, said radiating structure comprising four radiating elements arranged in a generally square configuration to define a square radiating structure having preselected dimensions, each of said radiating elements comprising a dielectric body having one or more conductive radiators thereon, said dielectric body having oppositely outwardly extending lateral edge portions which extend beyond lateral outer edges of said conductive radiators, and cooperating joining structure for interengaging an edge of each said dielectric body with an adjacent edge of an adjacent dielectric body so as to hold said four radiating elements together in assembled condition defining said square of preselected dimensions.

26. The antenna of claim 25 and further including a parasitic element for offsetting isolation degradation resulting from said reflector.

27. The antenna of claim 25 wherein said parasitic element comprises an elongated, relatively thin conductor extending diagonally opposite corners of the square defined by said radiating elements, said radiating elements being arranged relative to said reflectors such that said elongated conductor extends in a direction parallel to a shorter dimension of said reflector.

28. A radiating element for use in a dual-polarized radiating apparatus with isolation between polarization channels, said radiating element comprising: a dielectric body having one or more conductive radiators thereon, said dielectric body having oppositely outwardly extending lateral edge portions which extend beyond lateral outer edges of said conductive radiators, and means for interengaging one of said oppositely outwardly extending lateral edge portions of said dielectric body with an adjacent one of said oppositely outwardly extending lateral edge portions of a similar dielectric body to form at least a portion of said dual polarized radiating apparatus.

29. A dual-polarized radiating apparatus with isolation between polarization channels comprising four radiating elements arranged in a generally square configuration to define a square radiating structure having preselected dimensions, each of said radiating elements comprising a dielectric body having one or more conductive radiators thereon, said dielectric body having oppositely outwardly extending lateral edge portions which extend beyond lateral outer edges of said conductive radiators, and means for interengaging an edge of said dielectric body with an adjacent edge of a similar dielectric body to form at least a portion of said dual polarized radiating apparatus so as to hold said four radiating elements together in assembled condition and defining said square of preselected dimensions.

30. The apparatus of claim 29 and further including means for offsetting isolation degradation from the presence of reflector edges.

31. The apparatus of claim 30 wherein said offsetting means comprises a parasitic element extending diagonally across said square.

32. The apparatus of claim 29 wherein said means for interengaging comprises slots formed in said lateral outer edges of each said dielectric body configured and positioned for slidably interengaging complimentary slots in an adjacent dielectric body.

33. The apparatus of claim 29 wherein said means for interengaging comprises one or more tabs projecting from one lateral edge of said dielectric body and complementary slots adjacent an opposite lateral edge of said dielectric body.

34. An antenna structure comprising:

a reflector;

a feedboard mounted to said reflector; and a radiating structure mounted to said feedboard, said radiating structure comprising four radiating elements arranged in a generally square configuration to define a square radiating structure having preselected dimensions, each of said radiating elements comprising a dielectric body having one or more conductive radiators thereon, said dielectric body having oppositely outwardly extending lateral edge portions which extend beyond lateral outer edges of said conductive radiators, and means for interengaging an edge of each said dielectric body with an adjacent edge of an adjacent dielectric body so as to hold said four radiating elements together in assembled condition defining said square of preselected dimensions.

35. The antenna of claim 34 and further including means for offsetting isolation degradation resulting from said reflector.

* * * * *